US008231331B2

(12) United States Patent
Wu

(10) Patent No.: US 8,231,331 B2
(45) Date of Patent: Jul. 31, 2012

(54) REDUCTION OF FLOW-INDUCED NOISE IN A CENTRIFUGAL BLOWER

(75) Inventor: Sean F. Wu, Troy, MI (US)

(73) Assignee: Wayne State University, Detroit, MI (US)

( * ) Notice: Subject to any disclaimer, the term of this patent is extended or adjusted under 35 U.S.C. 154(b) by 1174 days.

(21) Appl. No.: 12/048,904

(22) Filed: Mar. 14, 2008

(65) Prior Publication Data

US 2009/0232648 A1 Sep. 17, 2009

(51) Int. Cl.
*F04D 29/66* (2006.01)

(52) U.S. Cl. ..... 415/119; 415/204; 415/206

(58) Field of Classification Search ..... 415/119, 415/204, 206; 416/231 R, 241 R
See application file for complete search history.

(56) References Cited

U.S. PATENT DOCUMENTS

| | | | | |
|---|---|---|---|---|
| 2,160,666 | A * | 5/1939 | McMahan | 415/119 |
| 2,171,341 | A * | 8/1939 | McMahan | 415/119 |
| 3,286,914 | A * | 11/1966 | Baverstock | 415/119 |
| 4,419,049 | A | 12/1983 | Gerboth et al. | |
| 4,859,150 | A | 8/1989 | Takigawa | |
| 4,869,644 | A | 9/1989 | Takigawa | |
| 5,169,290 | A * | 12/1992 | Chou | 416/236 R |
| 5,209,644 | A | 5/1993 | Dorman | |
| 5,257,902 | A | 11/1993 | Atarashi et al. | |
| 5,316,439 | A | 5/1994 | Gatley, Jr. et al. | |
| 5,536,140 | A | 7/1996 | Wagner et al. | |
| 5,540,406 | A | 7/1996 | Occhipinti | |
| 5,762,731 | A | 6/1998 | Dodd | |
| 5,772,399 | A | 6/1998 | Mehta et al. | |
| 5,868,551 | A | 2/1999 | Smiley, III et al. | |
| 6,004,102 | A | 12/1999 | Kuefner et al. | |
| 6,039,532 | A | 3/2000 | McConnell | |
| 6,538,887 | B2 * | 3/2003 | Belady et al. | 415/200 |
| 6,575,696 | B1 | 6/2003 | Lyons et al. | |
| 6,872,048 | B2 | 3/2005 | Uselton et al. | |
| 7,210,903 | B2 | 5/2007 | Lyons | |
| 7,278,823 | B2 | 10/2007 | Platz | |
| 2006/0034686 | A1 | 2/2006 | Smiley, III et al. | |
| 2006/0034697 | A1 | 2/2006 | Chen | |
| 2006/0110257 | A1 | 5/2006 | Huang | |

FOREIGN PATENT DOCUMENTS

| | | | |
|---|---|---|---|
| JP | 55164590 | A | 12/1980 |
| JP | 03237298 | A | 10/1991 |
| JP | 03294699 | A | 12/1991 |
| JP | 06108996 | A | 4/1994 |
| JP | 06137297 | A | 5/1994 |
| JP | 06159297 | A | 6/1994 |

* cited by examiner

*Primary Examiner* — Edward Look
*Assistant Examiner* — Adam Benson
(74) *Attorney, Agent, or Firm* — Brinks Hofer Gilson & Lione

(57) ABSTRACT

A centrifugal blowing apparatus for reducing flow-induced noise is disclosed. The apparatus includes a blower housing having a scroll section formed about a rotational axis and an exhaust section extending from the scroll section. The scroll section includes an opening defining an inlet configured to draw in air and the exhaust section defines an outlet in fluid communication with the inlet. The scroll section commences with a reduced cross-sectional area defining a cutoff and expands to an increased cross-sectional area. An impeller is disposed in the opening of the scroll section about the rotational axis and includes an outer surface having impeller blades radially disposed thereon. The impeller blades rotate to direct a flow of air from the inlet through the scroll section to the outlet. A plurality of indentations is formed along an inner surface of the scroll section at the cutoff.

20 Claims, 4 Drawing Sheets

REDUCTION OF FLOW-INDUCED NOISE IN A CENTRIFUGAL BLOWER

BACKGROUND

1. Field of the Invention

The present invention generally relates to centrifugal blowers. More particularly, the invention relates to a centrifugal blower having reduced noise generation.

2. Description of Related Art

Centrifugal fans or blowers, also known as scroll-type blowers, are utilized in a wide variety of applications where efficient movement of air is required, including HVAC systems for automobiles and office buildings.

One problem with existing blowers is the noise generated by the interaction between the airflow and the smooth inner surface of the blower housing. As air flows over the smooth surface, a thin boundary layer is formed which tends to adhere to the surface, due to viscosity, and flows smoothly over the surface, known as laminar flow. However, the presence of skin friction tends to slow down the laminar flow, causing it to grow thicker. Eventually, separation occurs and the flow becomes turbulent. As a consequence of this flow separation, aerodynamic sounds are generated. Flow separation noise is a major source of noise generation in the flow-induced sound of a centrifugal blower. This problem occurs most prominently along the cutoff due to the reduced cross-sectional area of the air passageway within the scroll section. Thus, the fluid-structure interaction at the cutoff is the major noise source in centrifugal blowers.

Centrifugal blowers are notorious for these extraneous sounds produced while the blower is in operation. Many people find these sounds to be unpleasant and annoying. Thus, there is a need in the art for an improved centrifugal blower having reduced flow-induced noise generation.

SUMMARY

Embodiments of the present invention provide a centrifugal blowing apparatus which effectively reduces flow-induced noise by providing a more efficient transition of airflow through the blower.

One embodiment of the present invention provides a centrifugal blowing apparatus for reducing flow-induced noise. The apparatus includes a blower housing having a first wall arcuately extending thereabout to define a scroll section formed about a rotational axis. The scroll section includes a circular opening formed therein which defines an inlet configured to draw in air. The scroll section commences with a reduced cross-sectional area at a first end and expands to an increased cross-sectional area at a second end. The reduced cross-sectional area defines a cutoff.

In this embodiment, the blower housing further includes a second wall extending from the first wall to define an exhaust section which includes an outlet in fluid communication with the inlet. An impeller is disposed in the opening about the rotational axis. The impeller comprises an outer surface having impeller blades radially disposed thereon. The impeller blades rotate to direct a flow of air from the inlet through the scroll section to the outlet. A plurality of indentations is formed along an inner surface of the scroll section at the cutoff.

In another embodiment, a centrifugal blowing apparatus for reducing flow-induced noise is provided. The apparatus includes a blower housing having a first wall arcuately extending thereabout to define a scroll section formed about a rotational axis. The scroll section includes a circular opening formed therein which defines an inlet configured to draw in air. The scroll section commences with a reduced cross-sectional area at a first end and expands to an increased cross-sectional area at a second end. The reduced cross-sectional area defines a cutoff.

In this embodiment, the blower housing further includes a second wall extending from the first wall to define an exhaust section which defines an outlet in fluid communication with the inlet. The exhaust section extends generally tangentially from the scroll section. The first wall integrally connects the scroll section to the exhaust section at a first portion where the first wall is generally parallel to the second wall. The first wall integrally connects the scroll section to the exhaust section at a second portion where the first wall and the second wall meet at a generally angled corner.

Further in this embodiment, an impeller is disposed in the opening about the rotational axis and comprises an outer surface having impeller blades radially disposed thereon. The impeller blades rotate to direct a flow of air from the inlet through the scroll section to the outlet. A plurality of indentations is formed along an inner surface of the scroll section at the cutoff.

Further objects, features and advantages of this invention will become readily apparent to persons skilled in the art after a review of the following description, with reference to the drawings and claims that are appended to and form a part of this specification.

DETAILED DESCRIPTION

The present invention generally provides a centrifugal blower having reduced noise generation. The blower includes a distinct surface roughness along an inner surface of a scroll-housing at a cutoff defined by a reduced airflow cross-sectional area within the scroll-housing. The unique surface roughness at the cutoff effectively reduces flow-induced noise by providing an efficient transition of airflow through the blower.

Figure 1A:
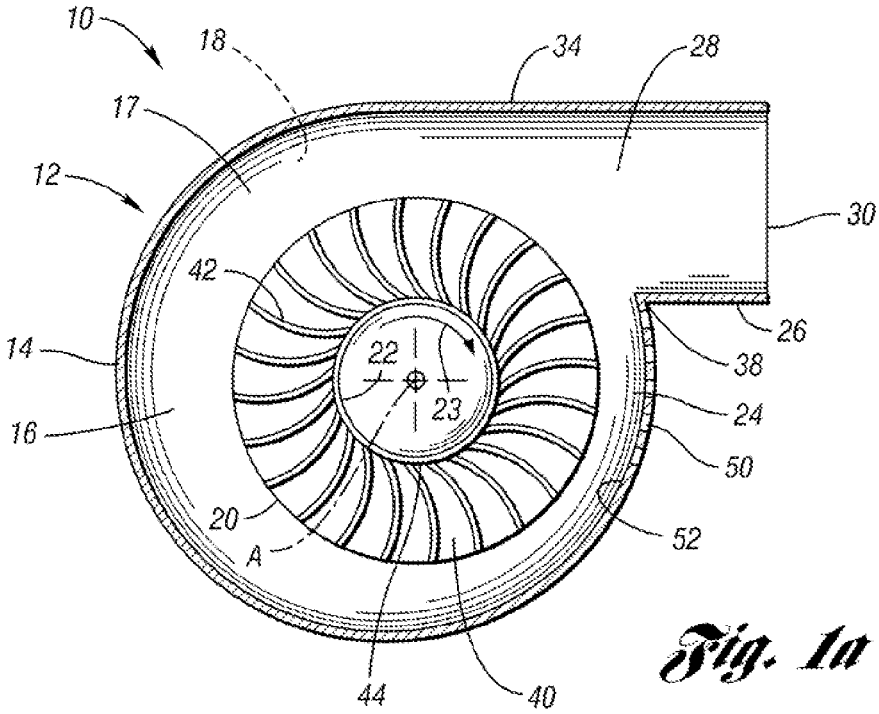
FIG. 1*a* is a side view of a centrifugal blowing apparatus in accordance with one embodiment of the present invention.
Figure 1B:
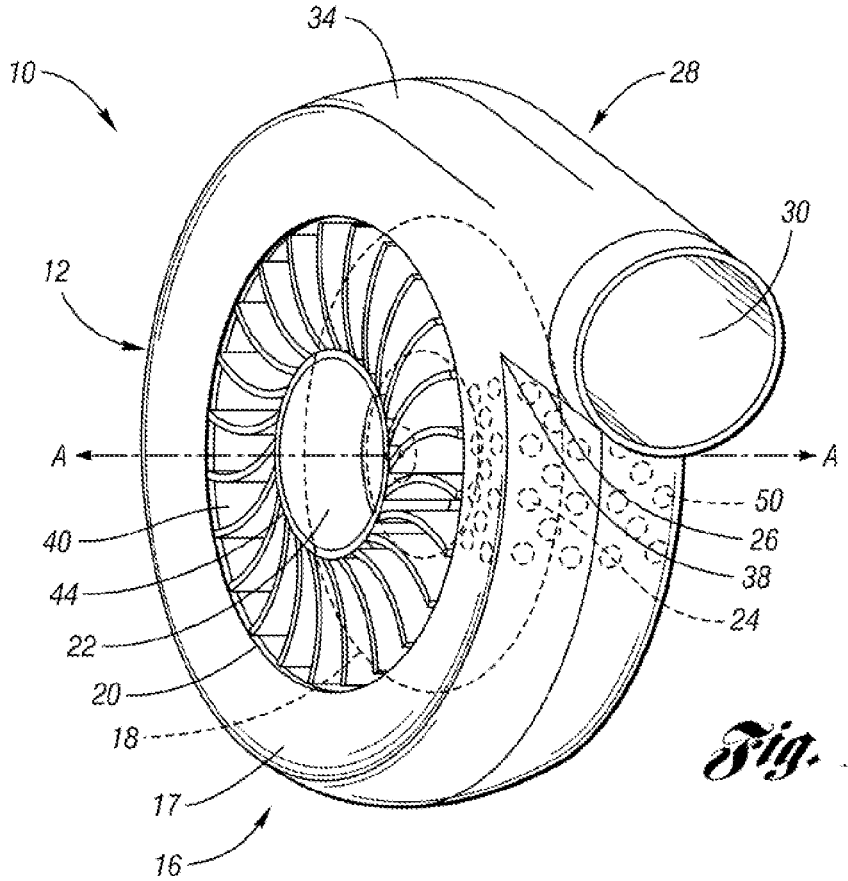
FIG. 1*b* is a perspective view of a centrifugal blowing apparatus in accordance with the embodiment depicted in FIG. 1*a;*

FIGS. 1*a-b* illustrate a centrifugal blower 10 constructed in accordance with one embodiment of the present invention. As shown, the blower 10 generally includes a scroll-shaped blower housing 12 formed of first and second sidewalls 17, 18 spaced apart by a scroll wall 14. In this embodiment, the scroll wall 14 arcuately extends about a rotational axis A to define a circular scroll section 16. The scroll section 16 includes a circular opening 20 formed therein through sidewalls 17, 18. The opening 20 defines an inlet 22 configured to draw in air.

The blower housing 12 further includes an outlet wall 26 extending from the scroll wall 14 to define part of an exhaust section 28. The exhaust section 28 defines an outlet 30 in fluid communication with the inlet 22. The exhaust section 28 extends radially from the scroll section 16 such that the scroll wall 14 defines part of the exhaust section 28.

In this embodiment, the scroll wall 14 integrally connects the scroll section 16 to the exhaust section 28 at a first portion 34, where the scroll wall 14 is generally parallel to the outlet wall 26. The scroll wall 14 arcuately extends about the rotational axis A to integrally connect the scroll section 16 to the exhaust section 28 at a second portion 38, where the scroll wall 14 and the outlet wall 26 define a generally angled corner or a sharply radiused edge. The overall shape of the blower housing 12 may be formed of metal or plastic via a molding process, such as injection molding. The blower housing 12 may be constructed using any securing means known in the art, including but not limited to reinforcement ridges, bolts, screws and threaded bosses, and/or connectors and connector tabs.

As shown, at least a portion of the scroll wall 14 of the scroll section 16 has a continuously increasing radius relative to the rotational axis A, resulting in a continuously increasing airflow cross-sectional area. The airflow cross-sectional area is defined by a plane that lies perpendicular to the general direction of airflow in the area of interest. Thus, the airflow cross-sectional area of the scroll section 16 expands from a reduced airflow cross-sectional area proximate the second portion 38, through a portion of a revolution about the rotational axis A, to an increased airflow cross-sectional area at the first portion 34 proximate the exhaust section 28. The reduced airflow cross-sectional area proximate the second portion 38 defines a cutoff 24, i.e., a narrow air passageway within the scroll section 16 having a smaller clearance area than the rest of the air passageway of the scroll section 16.

Thus, the radius of the scroll section 16 expands from a minimum radius at the cutoff 24, in a clockwise direction relative to the plane view shown in FIG. 1*a*, to an increased radius at the first portion, adjacent the exhaust section 28. The purpose of the cutoff 24 is to raise the pressure head so as to produce a desired amount of airflow. If the airflow cross-sectional area is constant throughout the air passageway of the scroll section 16, namely no cutoff 24, then there would be no pressure head and therefore no driving mechanism for the flow of air. Alternatively, if the clearance is too narrow, the resistance would be too high, which would reduce the efficiency of airflow delivery and increase noise generation. Thus, there is a compromise in the design of the cutoff 24.

In this embodiment, an impeller 40 is disposed in the opening 20 of the scroll section 16. The impeller 40 is of a conventional shape rotatably attached within the opening 20 by any suitable known means, and is configured to rotate about the rotational axis A. Impeller blades 42 are radially disposed along the outer surface 44 of the impeller 40. A motor including a rotational shaft (not shown) may be mounted to the blower housing 12 and the impeller 40 may be coupled to the motor and rotational shaft for rotation therewith by any known means.

During operation of the blower 10, the impeller 40 rotates within the blower housing 12 and draws a flow of air in through the inlet 22. The air entering through the inlet 22 is directed radially outward, through the scroll section 16 in a clockwise direction relative to the plane view shown in FIG. 1*a*, as illustrated by arrow 23, and exits the blower housing 12 through the outlet 30 of exhaust section 28. Although the blower housing 12 is configured in a clockwise orientation relative to the plane view shown in FIG. 1*a*, in which the shape of the blower housing 12 is configured for clockwise rotation of the impeller 40, the blower housing 12 may alternatively be configured in a counterclockwise orientation, in which the shape of the blower housing 12 is configured for counterclockwise rotation of the impeller 40.

Figure 3:
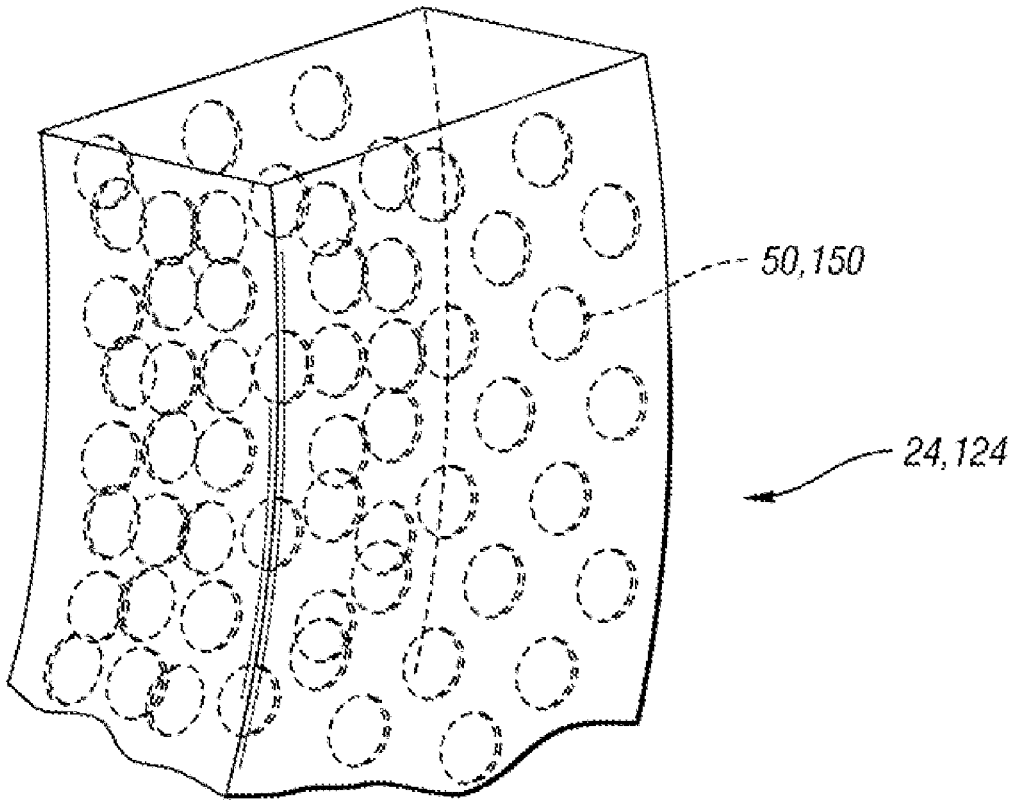
FIG. 3 is an expanded view of the cutoff section of the scroll housing of a centrifugal blowing apparatus in accordance with the present invention.
Figure 4:
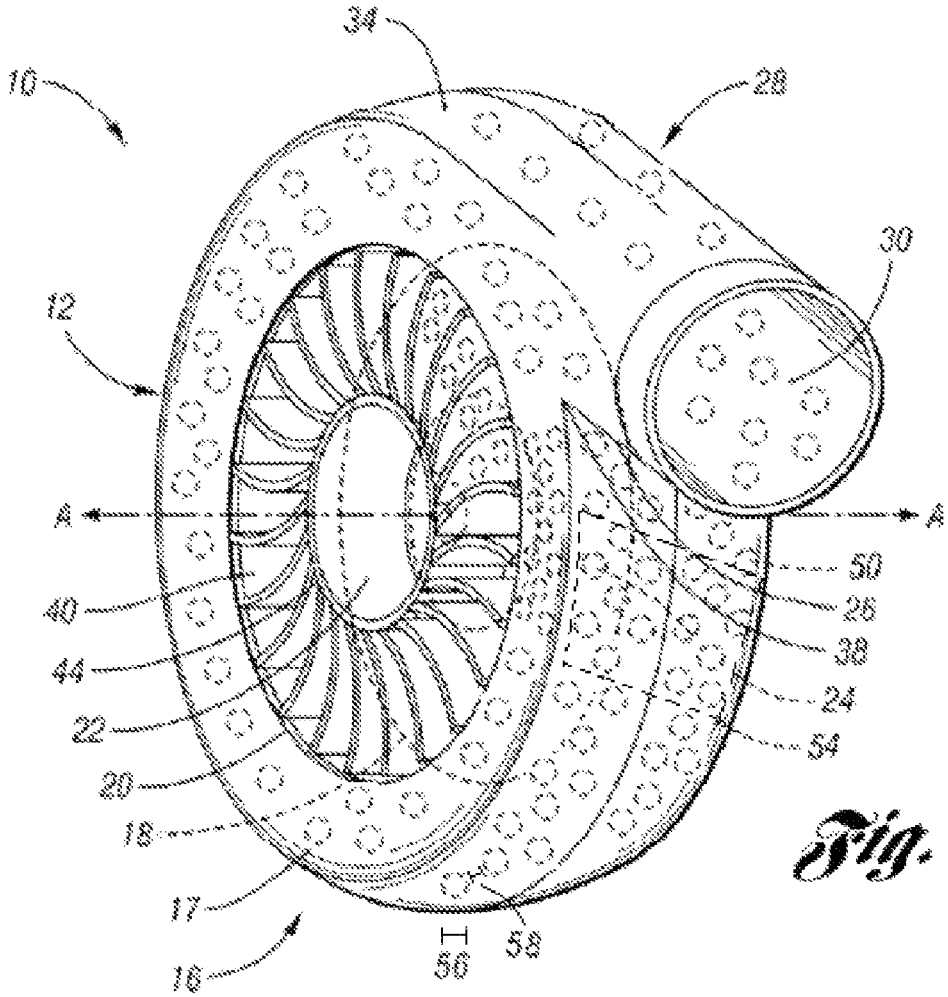
FIG. 4 is a perspective view of a centrifugal blowing apparatus in accordance with another embodiment of the present invention.

To suppress flow-induced noise, the surface roughness of the inner surface 52 along the cutoff 24 of the scroll section 16 of the centrifugal blower 10 of the present invention is modified. As illustrated in FIGS. 1*b* and 3, a plurality of indentations 50 is impressed along the inner surface 52 of the scroll section 16 at the cutoff 24. As shown in FIGS. 1*b* and 3, the inner surface 52 on which the indentations 50 are impressed includes the inner surface of the first and second sidewalls 17, 18 and the inner surface of the scroll wall 14. The plurality of indentations 50 may be formed within the blower housing 12 during the manufacturing process. For example, if the blower housing is formed via an injection molding process, the indentations 50 may be formed as part of the injection molding process. Alternatively, the indentations 50 may be formed after the manufacturing process by any suitable cutting or punching means. It is also within the scope of the present invention for the plurality of indentations 50 to be part of a separate attachment panel 54 configured to be attached within the scroll section 16 along the inner surface 52, as shown in FIG. 4. The separate attachment panel 54 may be formed of any suitable material such as plastic or metal.

To further aid in the elimination of noise generated by the fluid structure interaction of the centrifugal blower 10, the indentations 50 may be impressed along the inner surface 52 of the scroll section 16 beyond the cutoff 24 and may extend into the inner surface of the exhaust section 28 such that the inner surface along the entire blower housing 12 includes indentations 50 formed therein, as shown in FIG. 4. Additionally, the indentations 50 may be formed along the outer surface of the impeller blades 42, as shown in FIG. 4. The indentations 50 may have a diameter 56 between around 2 mm and around 4 mm and a thickness of between around 2 mm and around 4 mm, depending on the dimensions of the blower housing 12. The distance 58 between the indentations 50 may be between around 5 mm and around 10 mm. As air flows through the scroll section 16, the surface roughness created by the indentations 50 eliminates laminar flow and its transition to turbulent flow, and consequently reduces noise generation in the centrifugal blower 10.

Figure 2A:
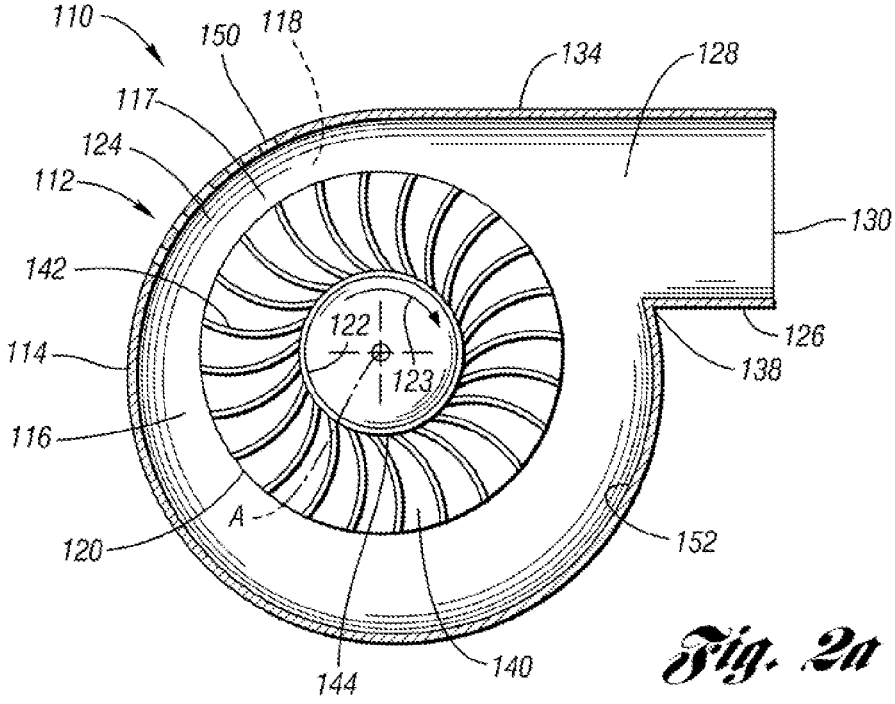
FIG. 2*a* is a side view of a centrifugal blowing apparatus in accordance with another embodiment of the present invention.
Figure 2B:
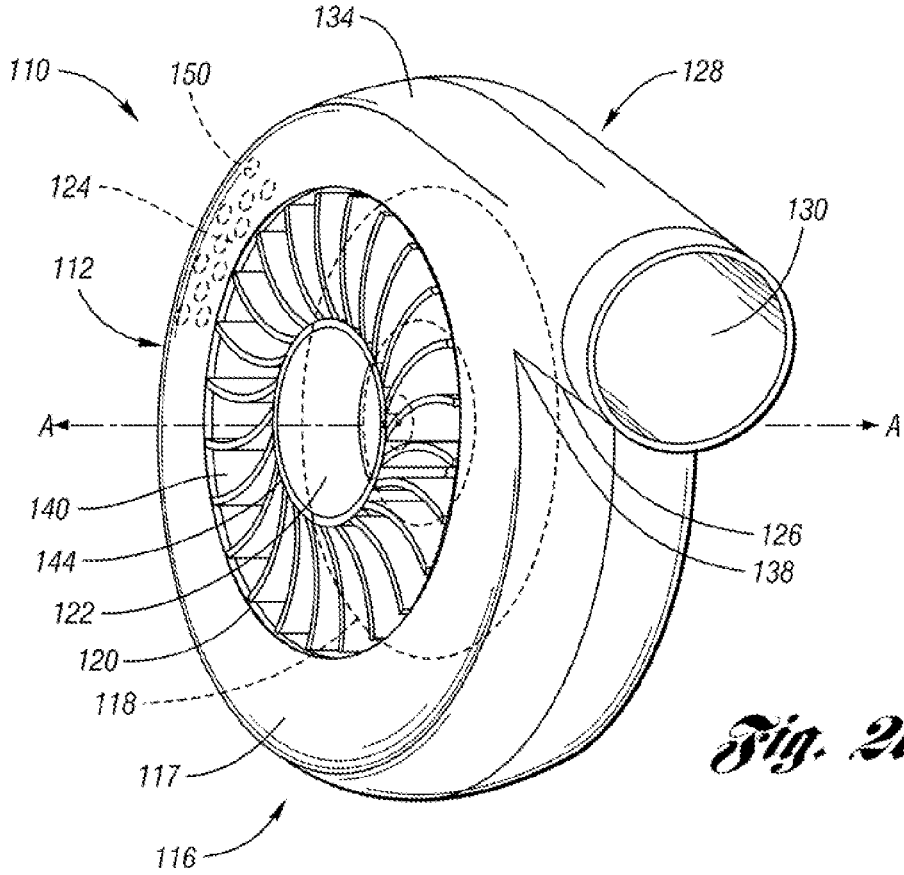
FIG. 2*b* is a perspective view of a centrifugal blowing apparatus in accordance with the embodiment depicted in FIG. 2*a;*

FIGS. 2*a-b* illustrate a centrifugal blower 110 constructed in accordance with a second embodiment of the present invention. As shown, the blower 110 generally includes a scroll-shaped blower housing 112 formed of first and second sidewalls 117, 118 spaced apart by a scroll wall 114. In this embodiment, the scroll wall 114 arcuately extends about a rotational axis A to define a circular scroll section 116. The scroll section 116 includes a circular opening 120 formed therein through sidewalls 117, 118. The opening 120 defines an inlet 122 configured to draw in air. The blower housing 112 further includes an outlet wall 126 extending from the scroll wall 114 to define part of an exhaust section 128. The exhaust section 128 defines an outlet 130 in fluid communication with the inlet 122. The exhaust section 128 extends radially from the scroll section 116 such that the scroll wall 114 defines part of the exhaust section 128.

In this embodiment, the scroll wall 114 integrally connects the scroll section 116 to the exhaust section 128 at a first portion 134, where the scroll wall 114 is generally parallel to the outlet wall 126. The scroll wall 114 arcuately extends about the rotational axis A to integrally connect the scroll section 116 to the exhaust section 128 at a second portion 138, where the scroll wall 114 and the outlet wall 126 define a generally angled corner or a sharply radiused edge.

As shown, at least a portion of the scroll wall 114 of the scroll section 116 has a continuously increasing radius relative to the rotational axis A, resulting in a continuously increasing airflow cross-sectional area. The airflow cross-sectional area is defined by a plane that lies perpendicular to the general direction of airflow in the area of interest. Thus, the airflow cross-sectional area of the scroll section 116 expands from a reduced airflow cross-sectional area proximate the first portion 134, through a portion of a revolution about the rotational axis A, to an increased airflow cross-sectional area proximate the exhaust section 128. The reduced airflow cross-sectional area proximate the first portion 134 defines a cutoff 124, i.e., a narrow air passageway within the scroll section 116 having a smaller clearance area than the rest of the air passageway of the scroll section 116. Thus, the radius of the scroll section 116 expands from a minimum radius at the cutoff 124, in a counterclockwise direction relative to the plane view shown in FIG. 2*a*, to an increased radius at the second portion 138, adjacent the exhaust section 128.

In this embodiment, an impeller 140 is disposed in the opening 120 of the scroll section 116. The impeller 140 is of a conventional shape rotatably attached within the opening 120 by any suitable known means, and is configured to rotate about the rotational axis A. Impeller blades 142 are radially disposed along the outer surface 144 of the impeller 140. A motor including a rotational shaft (not shown) may be mounted to the blower housing 112 and the impeller 140 may be coupled to the motor and rotational shaft for rotation therewith by any known means.

During operation of the blower 110, the impeller 140 rotates within the blower housing 112 and draws a flow of air in through the inlet 122. The air entering through the inlet 122 is directed radially outward, through the scroll section 116 in a clockwise direction relative to the plane view shown in FIG. 1*a*, as illustrated by arrow 123, and exits the blower housing 112 through the outlet 130 of exhaust section 128. Although the blower housing 112 is configured in a clockwise orientation relative to the plane view shown in FIG. 2*a*, in which the shape of the blower housing 112 is configured for clockwise rotation of the impeller 140, the blower housing 112 may alternatively be configured in a counterclockwise orientation, in which the shape of the blower housing 112 is configured for counterclockwise rotation of the impeller 140.

To suppress flow-induced noise, the surface roughness of the inner surface 152 along the cutoff 124 of the scroll section 116 of the centrifugal blower 110 of the present invention is modified. As illustrated in FIGS. 2*b* and 3, a plurality of indentations 150 is impressed along the inner surface 152 of the scroll section 116 at the cutoff 124. As air flows through the scroll section 116, the surface roughness created by the indentations 150 eliminates laminar flow and its transition to turbulent flow, and consequently reduces noise generation in the centrifugal blower 110.

Although the present invention has been described as including specific locations for the cutoff 24, 124, it should be understood that the present invention may be modified and should not be limited to the particular construction enclosed herein. For example, the cutoff 24, 124 may be disposed anywhere within the scroll section 16, 116 defined by a reduced clearance area for driving the flow of air.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

The invention claimed is:

1. A centrifugal blowing apparatus for reducing flow-induced noise, the apparatus comprising:

a blower housing having a scroll wall arcuately extending thereabout to define a scroll section formed about a rotational axis, the scroll section having a circular opening formed therein, the opening defining an inlet configured to draw in air, the scroll section commencing with a reduced cross-sectional area at a first end and expanding to an increased cross-sectional area at a second end, wherein the reduced cross-sectional area defines a cutoff, the blower housing further having an outlet wall extending from the scroll wall to define an exhaust section, the exhaust section defining an outlet in fluid communication with the inlet;

an impeller disposed in the opening about the rotational axis, the impeller comprising an outer surface having impeller blades radially disposed thereon, wherein the impeller is configured to rotate the impeller blades to direct a flow of air from the inlet through the scroll section to the outlet; and a plurality of indentations formed along an inner surface of the scroll section at the cutoff, wherein an entire surface of each indentation is formed by the inner surface of the scroll wall.

2. The apparatus of claim 1, wherein the exhaust section extends generally tangentially from the scroll section.

3. The apparatus of claim 2, wherein the scroll section includes first and second portions that are integrally connected to the exhaust section, wherein the first portion is defined by a part of the scroll wall that is generally parallel to the outlet wall, wherein the second portion is defined by a part of the scroll wall that meets the outlet wall at a generally angled corner.

4. The apparatus of claim 3, wherein the cutoff is disposed proximate the first portion, the cross-sectional area expanding from the cutoff to an increased cross-sectional area in a first direction.

5. The apparatus of claim 3, wherein the cutoff is disposed proximate the second portion, the cross-sectional area expanding from the cutoff to an increased cross-sectional area in a second direction.

6. The apparatus of claim 1, further comprising a plurality of indentations formed along the inner surface of the scroll section beyond the cutoff.

7. The apparatus of claim 1, further comprising a plurality of indentations formed along an outer surface of at least one impeller blade.

8. The apparatus of claim 1, further comprising a panel configured to attach within the blower housing along the inner surface of the scroll section at the cutoff, the panel having a plurality of indentations formed therein.

9. The apparatus of claim 1, each of the indentations having a diameter between around 2 millimeters and around 4 millimeters.

10. The apparatus of claim 1, each of the indentations having a thickness between around 2 millimeters and around 4 millimeters, wherein the thickness of each of the indentations is dependent upon a thickness of the blower housing.

11. The apparatus of claim 1, wherein each of the indentations is spaced apart from another indentation by a distance between around 5 millimeters and around 10 millimeters.

12. The apparatus of claim 1, wherein the blower housing further includes first and second sidewalls, wherein the plurality of indentations are further formed along an inner surface of at least one of the first and second sidewalls.

13. A centrifugal blowing apparatus for reducing flow-induced noise, the apparatus comprising:

a blower housing having a scroll wall arcuately extending thereabout to define a scroll section formed about a rotational axis, the scroll section having a circular opening formed therein, the opening defining an inlet configured to draw in air, the scroll section commencing with a reduced cross-sectional area at a first end and expanding to an increased cross-sectional area at a second end, wherein the reduced cross-sectional area defines a cutoff, the blower housing further having an outlet wall extending from the scroll wall to define an exhaust section, the exhaust section defining an outlet in fluid communication with the inlet, wherein the exhaust section extends generally tangentially from the scroll section, wherein the scroll section includes first and second portions that are integrally connected to the exhaust section, wherein the first portion is defined by a part of the scroll wall that is generally parallel to the outlet wall, wherein the second portion is defined by a part of the scroll wall that meets the outlet wall at a generally angled corner;

an impeller disposed in the opening about the rotational axis, the impeller comprising an outer surface having impeller blades radially disposed thereon, wherein the impeller is configured to rotate the impeller blades to direct a flow of air from the inlet through the scroll section to the outlet; and a plurality of indentations formed along an inner surface of the scroll section at the cutoff, wherein an entire surface of each indentation is formed by the inner surface of the scroll wall.

14. The apparatus of claim 13, wherein the cutoff is disposed proximate the first portion, the cross-sectional area expanding from the cutoff to an increased cross-sectional area in a first direction.

15. The apparatus of claim 13, wherein the cutoff is disposed proximate the second portion, the cross-sectional area expanding from the cutoff to an increased cross-sectional area in a second direction.

16. The apparatus of claim 13, further comprising a plurality of indentations formed along the inner surface of the scroll section beyond the cutoff.

17. The apparatus of claim 13, further comprising a plurality of indentations formed along an outer surface of at least one impeller blade.

18. The apparatus of claim 13, further comprising a panel configured to attach within the blower housing along the inner surface of the scroll section at the cutoff, the panel having a plurality of indentations formed therein.

19. The apparatus of claim 13, wherein the blower housing further includes first and second sidewalls, wherein the plurality of indentations are further formed along an inner surface of at least one of the first and second sidewalls.

20. A centrifugal blowing apparatus for reducing flow-induced noise, the apparatus comprising:

a blower housing having a scroll wall arcuately extending thereabout to define a scroll section formed about a rotational axis, the scroll section having a circular opening formed therein, the opening defining an inlet configured to draw in air, the scroll section commencing with a reduced cross-sectional area at a first end and expanding to an increased cross-sectional area at a second end, wherein the reduced cross-sectional area defines a cutoff, the blower housing further having an outlet wall extending from the scroll wall to define an exhaust section, the exhaust section defining an outlet in fluid communication with the inlet;

an impeller disposed in the opening about the rotational axis, the impeller comprising an outer surface having impeller blades radially disposed thereon, wherein the impeller is configured to rotate the impeller blades to direct a flow of air from the inlet through the scroll section to the outlet; and a plurality of indentations formed along an inner surface of the scroll section along the entire blower housing, wherein an entire surface of each indentation is formed by the inner surface of the scroll wall.

* * * * *